US005116253A

United States Patent [19]

Charitar et al.

[11] Patent Number: 5,116,253

[45] Date of Patent: May 26, 1992

[54] SHAMPOO STIMULATOR

[76] Inventors: Satendra Charitar, 37 E. Cavour St., Daly City, Calif. 94014; George Spector, 233 Broadway, Rm. 3815, New York, N.Y. 10007

[21] Appl. No.: 582,668

[22] Filed: Sep. 14, 1990

[51] Int. Cl.[5] ..... A45D 24/22

[52] U.S. Cl. ..... 132/114; 401/22; 401/28; 401/176; 401/268

[58] Field of Search ..... 132/112-116; 401/22, 28, 176, 268

[56] References Cited

U.S. PATENT DOCUMENTS

| | | | |
|---|---|---|---|
| 1,062,053 | 5/1913 | Strong | 401/28 X |
| 1,607,674 | 11/1926 | Ives | 132/114 |
| 2,624,348 | 1/1953 | Matson | 132/114 |
| 3,456,658 | 7/1969 | Long, Jr. | 132/116 |

FOREIGN PATENT DOCUMENTS

| | | | |
|---|---|---|---|
| 869247 | 7/1949 | Fed. Rep. of Germany | 132/114 |
| 325309 | 3/1935 | Italy | 132/114 |
| 7460 | of 1906 | United Kingdom | 132/114 |

*Primary Examiner*—Steven A. Bratlie

[57] ABSTRACT

A hair shampoo stimulator device is provided and consists of a rectangular frame slightly curved downwardly zigzag supports are affixed to and extend across the narrow portion of the frame in spaced apart relationships. Firm bristles are affixed to and face downwardly on each support. A shampoo solution dispenser is on the frame for dispensing the shampoo solution directly to a scalp of a person so that the bristles will foam the shampoo solution and massage the scalp to stimulate the hair roots.

2 Claims, 1 Drawing Sheet

SHAMPOO STIMULATOR

BACKGROUND OF THE INVENTION

The instant invention relates generally to liquid dispensing brushes and more specifically it relates to a hair shampoo simulative device which provides dispensing of a shampoo solution, foaming of the shampoo solution and massaging the user's scalp.

There are available various conventional liquid dispensing brushes which do not provide the novel improvements of the invention herein disclosed.

SUMMARY OF THE INVENTION

A primary object of the present invention is to provide a hair shampoo stimulator device that will overcome the shortcomings of the prior art devices.

Another object is to provide a hair shampoo stimulator device that will dispense shampoo solution therefrom and will include firm plastic bristles which will foam the shampoo solution and massage the scalp of a person using the device.

An additional object is to provide a hair shampoo stimulator that will dispense the shampoo solution directly to the scalp and to the firm plastic bristles carried on the frame of the device.

A further object is to provide a hair shampoo stimulator device that is simple and easy to use.

A still further object is to provide a hair shampoo stimulator device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
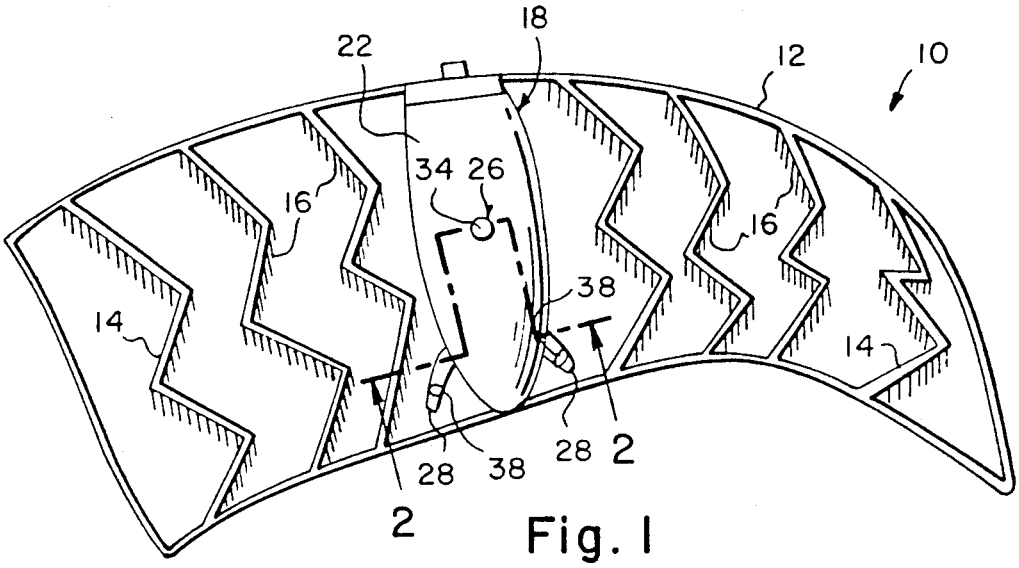
FIG. 1 is a perspective view of the invention.
Figure 2:
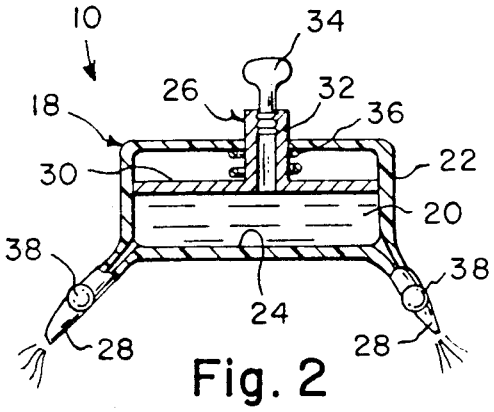
FIG. 2 is a cross sectional view taken along line 2—2 in FIG. 1 through the shampoo solution dispenser.

Turning now descriptively to the drawings, in which similar reference characters denote similar elements throughout the several views, FIGS. 1 and 2 illustrate a hair shampoo stimulator device 10 consisting of a rectangular frame 12 being slightly curved downwardly. A plurality of zigzag supports 14 are affixed to and extend across the narrow portion of the frame 12 in a spaced apart relationship. Firm bristles 16 are affixed to and face downwardly on each support 14. A shampoo solution dispenser 18 is on the frame 12 for dispensing shampoo solution 20 directly to a scalp of a person using the device 10. The bristles 16 will foam the shampoo solution 20 and massage the scalp of the person to stimulate the hair roots.

The dispenser 18 includes a container 22 affixed to and extends across the center of the narrow portion of the frame 12. The container 22 has a chamber 24 for holding the shampoo solution 20 therein. A manually operable pump 26 is reciprocally carried within the container 22. A pair of nozzles 28 are each fluidly connected to one bottom edge of the container 22 so that when the pump 26 is activated the nozzles 28 will spray some of the shampoo solution 20 out of the chamber 24 onto the scalp.

The pump 26 includes a plunger 20 slideably supported in the container 22. A hollow shaft 32 extends upwardly through the top of the container 22 and is affixed to the plunger 30. The chamber can be filled with the shampoo solution through the hollow shaft 32. A knob 34 is removably threaded into the top of the hollow shaft 32 to seal the chamber 24 after it is filled. A tension spring 36 is affixed about the hollow shaft 32 within the chamber 24 to pull the plunger 30 in an upward direction.

Each nozzle 28 further includes a one way check valve 38 to allow some of the shampoo solution 20 to spray out therefrom when the plunger 30 moves down and to prevent air from entering the chamber 24 when the plunger 30 moves back up.

Figure 3:
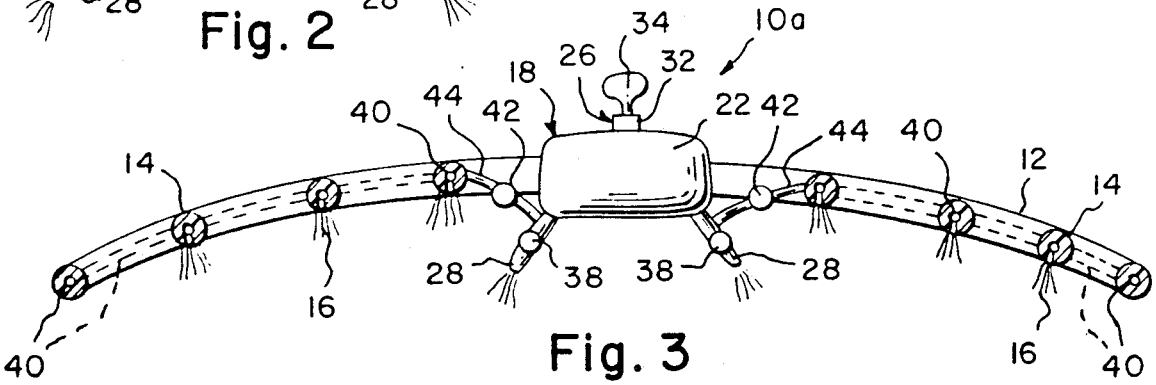
FIG. 3 is a longitudinal cross section of a modification in which the shampoo solution release nozzles are fluidly connected to go through the hollow frame and bristles.

FIG. 3 shows a modified device **10*a* in which the frame 12 and the zigzag supports 14 have hollow interconnecting channels 40 therethrough fluidly connected with the bristles 16. Each nozzle 28 has a second one way valve 42 fluidly connected via tubes 44 to the channels 40 so that when the pump 26 is activated some of the shampoo solution 20 will also come out onto the bristles 16**.

The frame 12, the supports 14, the bristles 16 and the dispenser 18 can all be fabricated out of durable plastic material or other durable materials.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A hair shampoo stimulator device comprising:

a) an open frame being slightly curved downwardly;

b) a plurality of zigzag supports affixed to and extending across a narrow portion of said frame in a spaced apart relationship;

c) a plurality of bristles affixed to and facing downwardly on each said support; and d) means on said frame for dispensing shampoo solution directly to a scalp of a person using said device so that said bristles will foam the shampoo solution and massage the scalp of the person to stimulate the hair roots; wherein aid dispensing means includes:

e) a container affixed to and extending across the center of said narrow portion of said frame with said supports arranged substantially uniformly therefrom, said container having a chamber for holding the shampoo solution therein;

f) a manually operable pump reciprocally carried within said container;

g) a pair of nozzles, each fluidly connected to one bottom edge of said container so that when said pump is activated said nozzle will spray some of the shampoo solution out of the chamber onto the scalp;

h) a plunger slideably supported in said container;

i) a hollow shaft extending upwardly through the top of said container and affixed to said plunger so that the chamber can be filled with the shampoo solution through said hollow shaft;

j) a tension spring affixed about said hollow shaft within said chamber to pull said plunger in an upward direction.

2. A hair shampoo stimulator device as recited in claim 1, wherein each said nozzle further includes a one way check valve to allow some of the shampoo solution to spray out therefrom when said plunger moves down and to prevent air from entering the chamber when said plunger moves back up; further including:

a) said frame and said zigzag supports having hollow interconnecting channels therethrough fluidly connected with said bristles; and b) each said nozzle having a second one way valve fluidly connected to said channels so that when said pump is activated some of the shampoo solution will also come out onto said bristles.

* * * * *